United States Patent [19]

Newbegin

[11] 4,086,855

[45] May 2, 1978

[54] SHALLOW CONVEYOR SYSTEM

[75] Inventor: John L. Newbegin, Easton, Pa.

[73] Assignee: SI Handling Systems, Inc., Easton, Pa.

[21] Appl. No.: 674,018

[22] Filed: Apr. 5, 1976

[51] Int. Cl.[2] ..... B61B 10/04

[52] U.S. Cl. ..... 104/172 BT; 59/84; 74/250 C; 104/172 C

[58] Field of Search ..... 104/172 R, 172 BT, 172 C, 104/172 S, 178, 235, 88; 198/725, 834; 74/245 R, 245 C, 250 R, 250 C; 59/78, 78.1, 84, 85, 87, 90, 91

[56] References Cited

U.S. PATENT DOCUMENTS

| | | | |
|---|---|---|---|
| 2,120,052 | 6/1938 | Bishop | 104/88 |
| 3,040,874 | 6/1962 | Lyman | 104/172 R X |
| 3,669,027 | 6/1972 | Haase et al. | 104/172 BT |
| 3,714,903 | 2/1973 | Rosenberger, Jr. et al. | 104/172 BT X |
| 3,774,545 | 11/1973 | Karlstrom | 104/172 C |

FOREIGN PATENT DOCUMENTS

| | | | |
|---|---|---|---|
| 727,279 | 3/1955 | United Kingdom | 104/172 BT |

*Primary Examiner*—Drayton E. Hoffman
*Assistant Examiner*—Randolph A. Reese
*Attorney, Agent, or Firm*—Seidel, Gonda & Goldhammer

[57] ABSTRACT

A shallow low cost conveyor system is disclosed for use with tow vehicles. The conveyor chain is provided with a drive which includes two idler sprockets and a drive sprocket all disposed to one side of the tow pin slot so that there is no chain in the adjacent portion of the slot. An auxiliary transfer mechanism transfers the tow pin across said portion of said slot.

12 Claims, 7 Drawing Figures

SHALLOW CONVEYOR SYSTEM

BACKGROUND

It is believed that the subject matter involved herein is classifiable in class 104, subclass 88 and/or 172.

Shallow or low profile conveyor systems have been proposed heretofore for use in connection with a tow vehicle. For example, see U.S. Pat. No. 3,389,662. The present invention is an improvement over the system disclosed in that patent for the reasons to be set forth hereinafter. The present invention accomplishes its intended result at a lower cost and can be used in areas which will not permit the conveyor drive motor to be mounted below floor level. As shown in FIGS. 21–23 of said patent, the conveyor drive has substantial vertical height which is mounted below floor level and thereby is limited in the number of applications in which it can be accommodated.

The present invention is directed to a shallow conveyor system for use with tow vehicles and includes an endless tow conveyor chain which is mounted beneath a slot in a support surface such as a floor. The drive for the chain includes two idler sprockets adjacent said slot and a drive sprocket. All of said sprockets are disposed to one side of said slot. A motor is coupled to the drive sprocket.

The said sprockets are rotatable about parallel upright axes. The axes form a triangle with the base of the triangle being an imaginary line extending between the axes of the idler sprockets and generally parallel to the direction of the slot adjacent thereto. A portion of the chain extends from one idler sprocket to the drive sprocket and then to the other sprocket so that the portion of the slot adjacent said idler sprockets does not contain the chain. An auxiliary transfer mechanism adjacent said portion of the slot includes at least one movable finger synchronized with chain movement for transferring a tow pin along said portion of the slot.

The present invention in its preferred construction can be utilized in environments which are not adapted for having deep recesses to receive the conveyor drive. Thus, the entire floor recess for the entire system of the present invention is shallow whereby the system is low in cost. In a typical system utilized heretofore, it was necessary to provide a pit of a depth of one foot or more in the concrete floor. The need for such pits are eliminated by the present invention. Thus, in the present invention, the depth of the area containing the conveyor drive is no deeper than the remainder of the slot containing the chain whereby installation and maintenance are materially simplified and the cost of the same reduced.

It is an object of the present invention to provide a shallow conveyor system for use with tow vehicles which is more economically constructed and less expensive to install or maintain as compared with the prior art.

It is another object of the present invention to provide a conveyor system having a conveyor chain which lacks a "hand" thereby minimizing problems in diverting from or merging thereto.

Other objects will appear hereinafter.

For the purpose of illustrating the invention, there is shown in the drawings a form which is presently preferred, it being understood, however, that this invention is not limited to the precise arrangements and instrumentalities shown.

Figure 1:
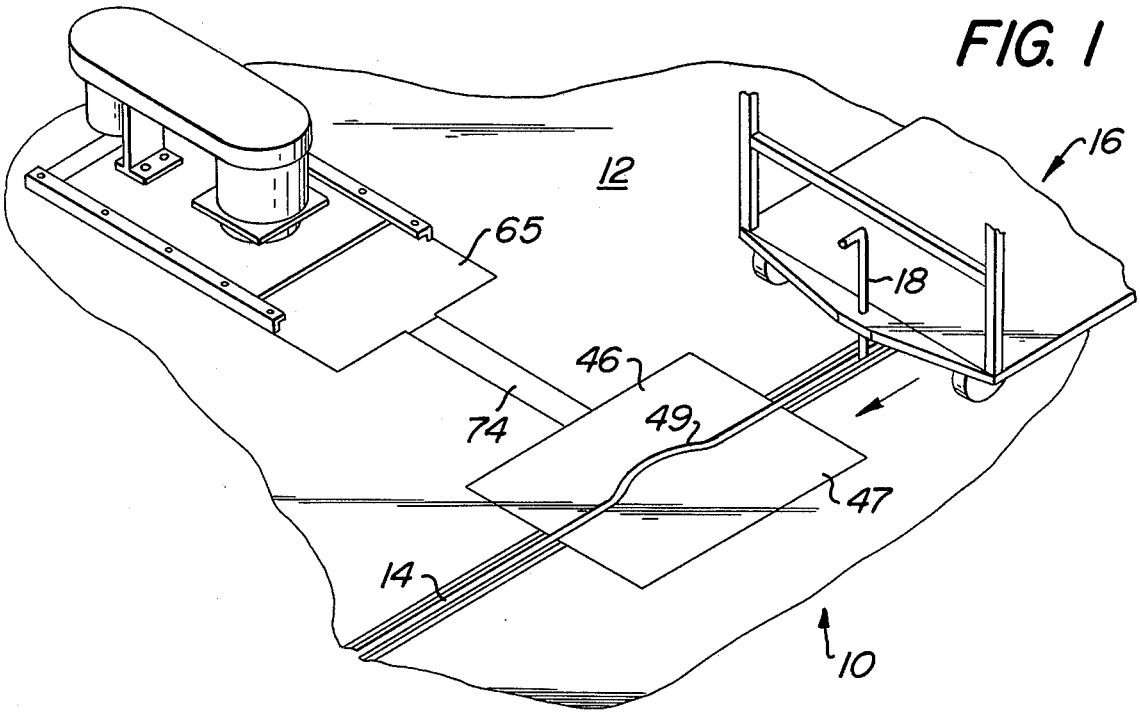
FIG. 1 is a partial perspective view of an endless conveyor system in accordance with the present invention and illustrating the drive portion thereof.

Referring to the drawing in detail, wherein like numerals indicate like elements, there is shown in FIG. 1 a conveyor system in accordance with the present invention designated generally as 10. The system 10 is in the form of a closed loop as is conventional in the art and includes a conveyor chain disposed beneath a main or auxiliary guide slot in a support surface. In FIG. 1, the support surface is designated 12 and is generally the floor in a building. Due to the unique features of the present invention, the floor 12 need not be the ground floor but may be any floor of a building. The main guide slot in floor 12 is designated as 14.

A tow vehicle 16 of the driverless type follows the main slot 14 and may be switched to an auxiliary slot intersecting therewith while rolling along the floor 12. Adjacent the front end of the vehicle 16, there is provided a tow pin 18 which is vertically movable and has a lower portion wherein it extends into the guide slot 14 for contact with a pusher surface on a conveyor chain 20.

Figure 5:
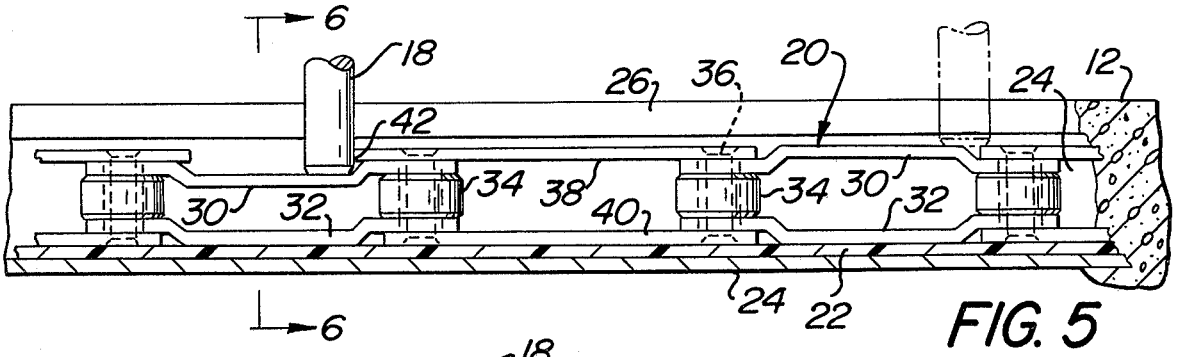
FIG. 5 is a vertical sectional view through a portion of the conveyor slot at a location spaced from the drive.
Figure 6:
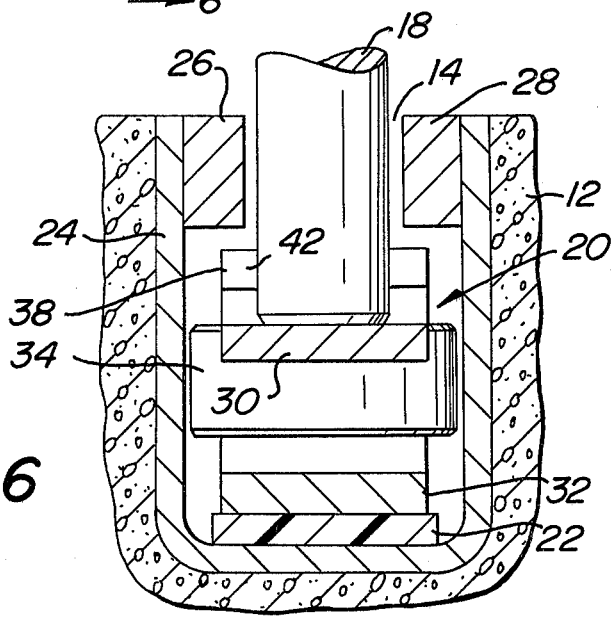
FIG. 6 is a sectional view taken along the line 6—6 in FIG. 5 but on an enlarged scale.

The conveyor chain 20 is shown in FIGS. 5 and 6. Chain 20 slides on a wear strip 22 of a polymeric plastic material such as high density polyethylene. The wear strip 22 overlies and preferably is bonded to the bight of a U-shaped track 24. Track 24 is mounted so that its open upper end is flush with the floor 12. Spaced guide strips 26 and 28 are metallurgically joined to the upright legs of the track 24 in any convenient manner such as by welding and the juxtaposed surfaces on strips 26, 28 define the main guide slot 14.

Track 24 is preferably made so as to have a width of about 2 inches and a depth of about 3 to 3½ inches. Thus, it will be appreciated that the concrete floor 12 can accommodate the track 24 with a shallow, narrow channel.

The chain 20 is preferably constructed of only three different links. A first type of link is designated 30. Link 30 has a flat planar central portion with offset ends lying in the same plane. Link 32 is identical with link 30 but orientated back-to-back so that the ends are closer together as compared with the central portion. A major face of link 32 is in contact with the upper surface on the wear strip 22.

Links 38 and 40 are identical but link 38 is longer. Links 38, 40 constitute the second type of link. Links 38 and 40 are flat strips having the same width as the width of links 30, 32. A roller 34 rotatable about a vertical pin 36 is provided. The pin 36 pivotably interconnects adjacent ends of links 30, 32, 38 and 40 with the roller 34 being disposed between the juxtaposed ends of link 30, 32. Rollers 34 have a diameter greater than the width of links 30, 32, 38, 40.

In order to obtain a pushing surface for contact with the lower end of the tow pin 18, link 30 at spaced points along the chain 20 is flipped over so as to match the configuration and orientation of link 32. See the left-hand end of FIG. 5 wherein the central portion of link 30 is at an elevation below the elevation of its end portions. This provides a depression in the chain 20 to accommodate a tow pin so that it may contact the pushing surface 42 on one end of the link 38.

The pitch of the chain 20, that is the distance between the vertical axes of adjacent pins 36, is preferably 150 millimeters. Because of the rollers 34, the need for rollers on the track adjacent a turn in the track 24 has been eliminated. Further, chain 20 can negotiate turns in the track 24 having a radius as low as 24 inches. A typical example of the use of rollers at a turn in a track is shown in FIG. 1 of said U.S. Pat. No. 3,389,662.

The conveyor includes a drive and means for taking up of slack in the chain 20. As a part thereof, there is provided a housing 44 embedded into the floor 12 and flush at its upper edge with the floor 12. See FIG. 2. The housing 44 has a height corresponding generally to the height of the track 24. One end of track 24 is connected to a side wall of housing 44 and the opposite end of the track is connected to an opposite side wall of the housing 44.

The housing 44 is provided with a cover comprised of halves 46 and 47 having their upper surface flush with the floor 12. The cover halves 46, 47 are removably bolted to and supported by appropriate flanges in the housing 44. Vertical portions 45 at spaced locations in housing 44 also support the cover halfs 46, 47. The halves 46 and 47 are spaced from one another so as to define a gap 49 forming a continuation of the main slot 14.

Figure 2:
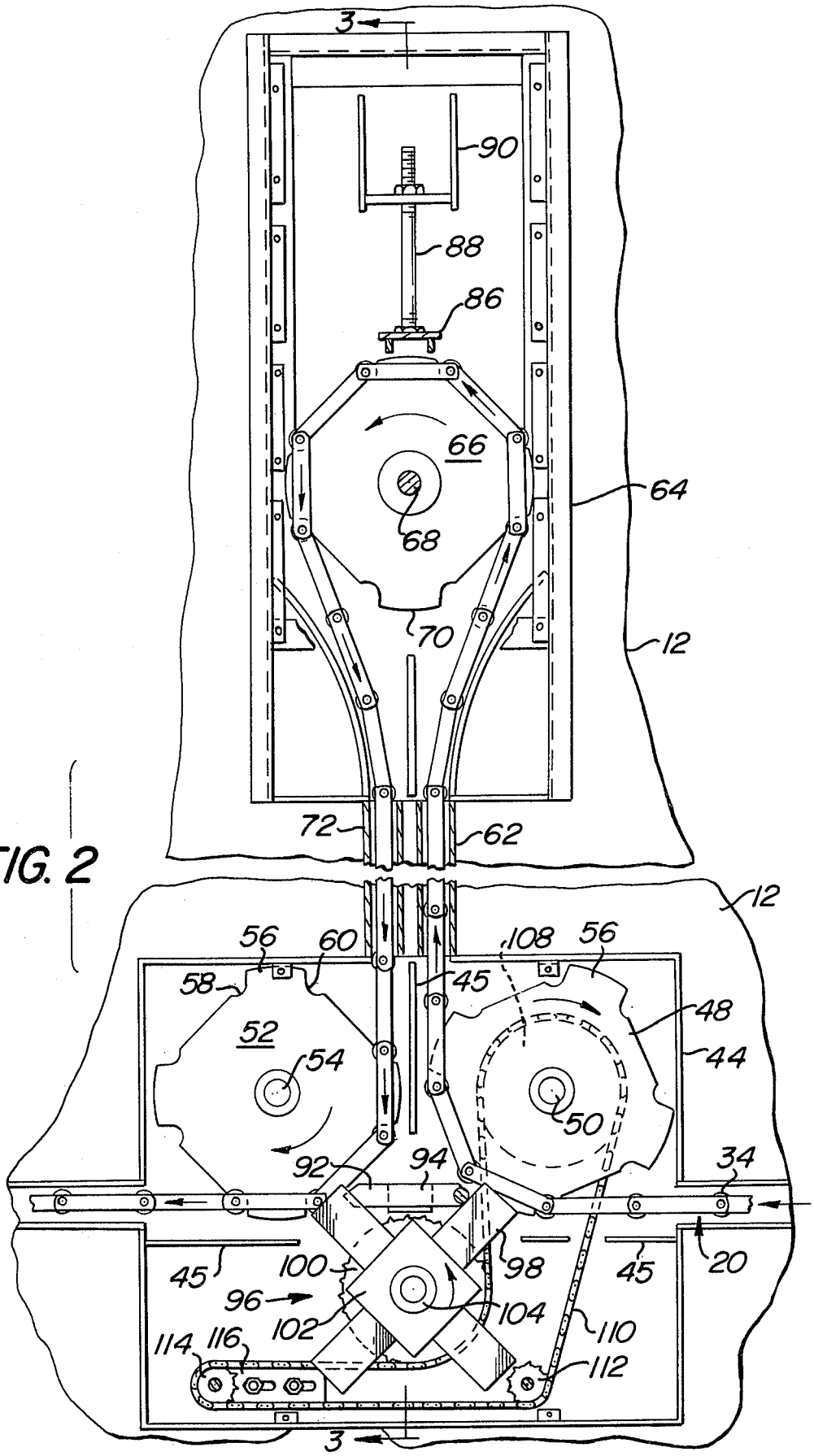
FIG. 2 is a top plan view of the drive in FIG. 1 with the cover plates removed and on an enlarged scale.
Figure 3:
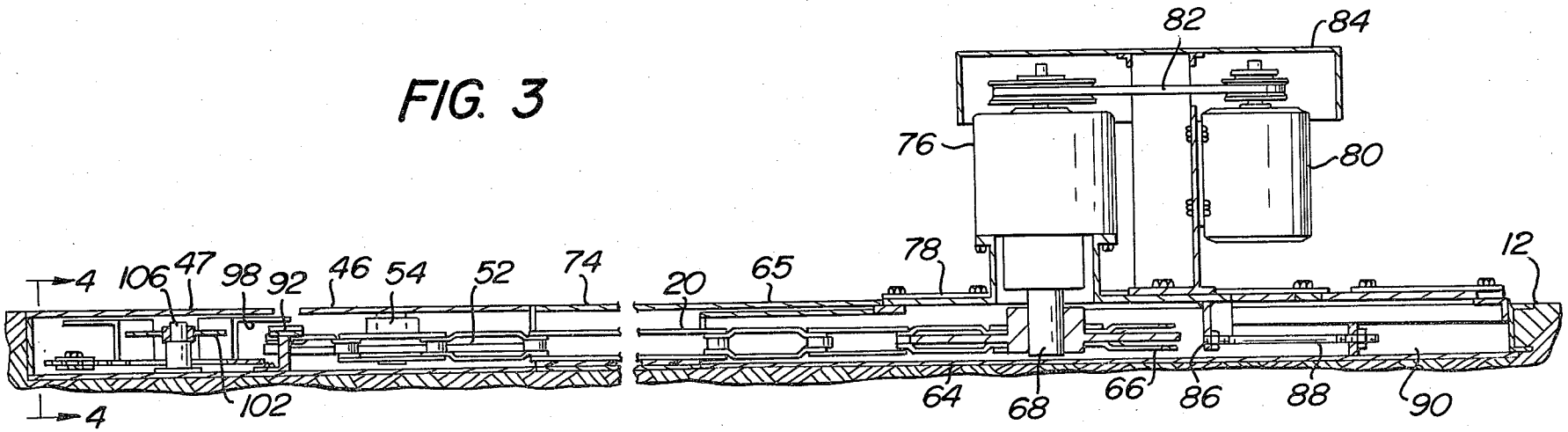
FIG. 3 is a sectional view taken along the line 3—3 in FIG. 2.

As shown more clearly in FIGS. 2 and 3, the housing 44 includes a pair of sprockets 48 and 52. Sprocket 48 rotates about an upright axis of pin 50. Sprocket 52 rotates about the upright axis of pin 54. An imaginary line extending between the axes of pins 50, 54 is generally parallel to the direction of movement of vehicle 16 in the adjacent portion of the conveyor.

Each of the sprockets 48 and 52 are identical. Each sprocket includes a plurality of lobes 56 with recessed grooves 58, 60 on opposite sides thereof. The grooves 58, 60 accommodate the rollers 34 of the chain 20. The lobes 56 are adapted to extend horizontally into the gap between the links of the chain. Sprockets 48, 56 can have a small radius of about 8 inches and will at all times be in contact with at least two adjacent links of the chain 20.

From the sprocket 48, the chain 20 extends through a guide channel 62 into a drive housing 64 having a removable cover 65. The upper surface of cover 65 is flush with the floor 12. The depth of the housing 64 corresponds to the depth of housing 44 and track 24. See FIG. 3.

Within housing 64, there is provided a drive sprocket 66 substantially identical with sprockets 48, 52. The drive sprocket 66 is driven by shaft 68. Drive sprocket 66 has lobes and arcuate recesses on opposite sides thereof in the same manner as described above in connection with sprockets 48, 52.

From the drive sprocket 66, the chain 20 extends through a guide channel 72 to the sprocket 52. A removable cover 74, flush with the floor 12, overlies the channels 62, 72.

As shown more clearly in FIG. 3, the drive shaft 68 is connected to a speed reducer 76 mounted on plate 78. The mounting plate 78 also supports an electric motor 80 connected to the speed reducer 76 in any convenient manner such as by a belt 82. A hood and guard 84 is mounted on plate 78 and overlies the motor 80 and speed reducer 76.

The mounting plate 78, speed reducer 76, and motor 80 are adjustable in a direction toward and away from the housing 44 for minor adjustment of tension and/or slack of the chain 20. Such movement of plate 78 likewise moves the driving sprocket 66. The adjusting means may assume a wide variety of configurations. As illustrated, the means for adjusting the position of plate 78 includes a depending bracket 86 connected to one end of a bolt 88. Bolt 88 extends through a hole in a brace 90 secured to the housing 64. A nut is attached to the bolt 88 on the opposite side of the brace 90. A removable access panel facilitates access to the nut on bolt 88 whereby adjustment with respect to slack may be quickly and easily made.

Figure 7:
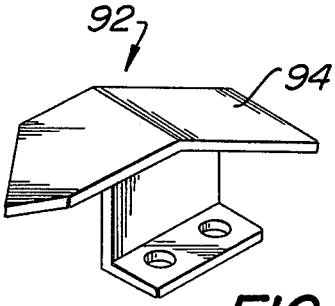
FIG. 7 is a perspective view of the transfer ramp shown in FIGS. 2 and 4.

In view of the fact that the chain 20 extends partially around sprocket 48, around drive sprocket 66, and then returns to sprocket 52 before continuing along the track 24, there is a zone below a major portion of the gap 49 which does not contain a chain in pushing contact with the tow pin 18. In that zone, there is provided a ramp 92 having an inclined portion 94. See FIGS. 2 and 7. As the chain begins to extend around the sprocket 48, the vehicle 16 will continue to move in its original direction. The lower end of the tow pin will drop off the chain 20 and will be cammed up to its original elevation by the inclined portion 94. A means is provided to positively propel the tow pin 18 up the inclined portion 94 and along the ramp 92 without materially changing the speed of the vehicle 16.

Figure 4:
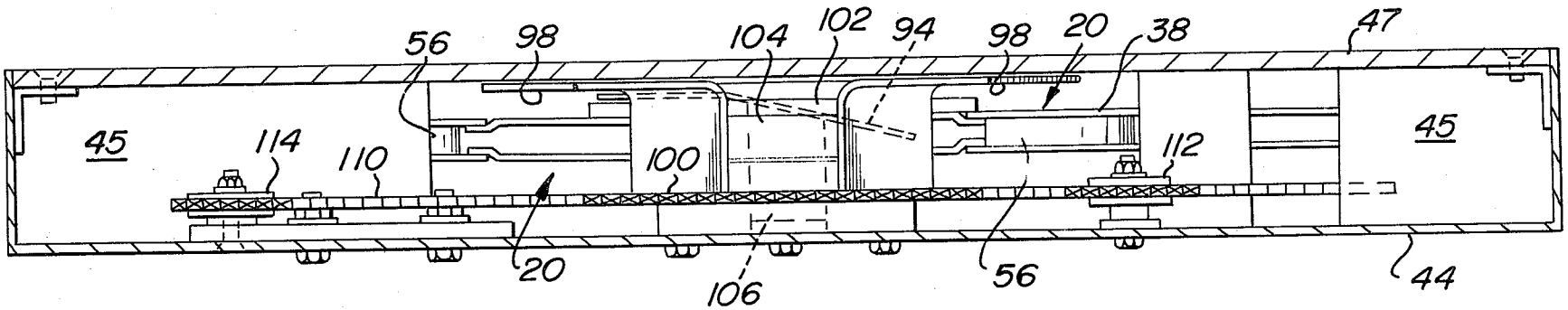
FIG. 4 is a sectional view taken along the line 4—4 in FIG. 3 but on an enlarged scale.

Referring to FIGS. 2 and 4, there is provided a transfer mechanism for positively transferring the tow pin 18 across the non-driven zone in timed relationship with the movement of the chain 20. The transfer mechanism 96 includes a plurality of outwardly extending fingers 98. As illustrated, four such fingers are provided. For ease of manufacture, the fingers 98 are L-shaped with the lower edge of the vertically disposed portion fixedly secured to a sprocket 100. Adjacent the upper edge of the vertically disposed portion, the fingers 98 are fixedly secured to the periphery of a plate 102. Plate 102 has a centrally disposed hole receiving a hub 104. Hub 104 is rotatably supported for rotation about the vertical axis of pin 106.

As shown in FIG. 1, the gap 49 defined by the mating juxtaposed edges of cover halves 46 and 48 is partially arcuate. The arcuate portion of the gap 49 is preferably provided with a radius of curvature corresponding to the axis of pin 106. While the arcuate portion of the gap 49 is not essential, it assists in minimizing wear between the tow pin and the fingers 98 and also maintains the uniform speed of the vehicle 16 since tow pin 18 will remain in contact with a portion of the fingers 98 rather than sliding along fingers 98.

The transfer mechanism is coupled to one of the sprockets 48, 52 so as to be in synchronization with the chain 20. Thus, sprocket 48 is provided with a sprocket 108 adjacent its lower end. Sprocket 108 is at the same elevation as sprocket 100. A chain 110 extends around sprocket 108, around idler sprockets 112, 114, and is in contact with sprocket 100 as illustrated more clearly in FIG. 2 so as to cause the fingers 98 to rotate in a direction opposite to the direction of rotation of sprockets 48, 52. One of the idler sprockets 112, 114 is preferably adjustable to properly tension chain 110. Thus, sprocket 114 is mounted on an adjustable plate 116 to facilitate proper tensioning of the chain 110. Sprockets 100 and 108 are preferably identical in diameter.

With the structure as described above and illustrated in the drawings, the chain 20 moves along the track 24 under the influence of drive sprocket 66. As the chain 20 moves along the track 24, it contacts the tow pin 18 on a plurality of different vehicles 16 thereby causing the vehicle 16 to move along the guide slot 14. At various locations along the conveyor system, auxiliary spur slots may be provided in a conventional manner. Also, if desired, the conveyor system may include other conventional apparatus such as apparatus for selectively stopping vehicles by interrupting the connection between any vehicle 16 and the chain 20 for purposes of loading and/or unloading of the vehicles.

As a vehicle 16 approaches the housing 44, the tow pin 18 will transfer from the slot 44 into the straight portion of the gap 49. As the tow pin 18 approaches the beginning the arcuate portion of the gap 49, it loses contact with the chain 20 since the pushing surface 42 has now moved around the sprocket 48. Immediately thereafter, the tow pin 18 will descend until it contacts the inclined portion 94. Also, the tow pin 18 will be contacted by one of the fingers 98 which pushes the tow pin 18 up the inclined portion 94 and along the ramp 92 in timed relationship with the chain 20 and at substantially uniform speed.

When the tow pin 18 reaches the end of the ramp 92, that is the lefthand end thereof in FIG. 2, it will be pushed off the ramp 92 into a pocket such as that shown on the lefthand end of the chain 20 in FIG. 5 whereby it will be again contacted by a pushing surface 42. As a consequence thereof, the tow pin 18 will lose contact with the finger 98 which continues to rotate. As will be apparent from FIG. 4, the elevation of the fingers 98 is above the elevation of the chain 20.

The chain 20, as described above and illustrated in the drawings, has no "hand". That is, the tow pin 18 may be discharged to the left or to the right. Also, the sprockets 48, 52 may engage the chain 20 from the left or the right. As a result thereof, the conveyor of the present invention is more versatile in that switching to auxiliary slots may be to the right or to the left of the main slot 14.

The entire conveyor and its drive are shallow and at approximately the same depth. Thus, deep pits are not required. All of the sprockets rotate about a vertical upright axis. No maintenance is required at turns in the conveyor track in view of the fact that a roller is provided at spaced points along the chain according to the pitch of the chain. Adjustment of chain tension is readily accomplished above floor level even while the chain is moving. As a result of the construction of the conveyor of the present invention, maintenance and installation are simplified and reduced in cost while operating at a lower sound level to minimize noise pollution. In connection with the quietness of operation, it will be noted that the chain slides on the plastic wear strip 22 and the chain 20 only has rolling contact with the track 24 by way of the rollers 34.

The present invention may be embodied in other specific forms without departing from the spirit or essential attributes thereof and, accordingly, reference should be made to the appended claims, rather than to the foregoing specification as indicating the scope of the invention.

I claim:

1. A shallow conveyor system for use with two vehicles comprising:

(a) a support surface, a track embedded in the support surface and having a tow pin guide slot, a tow conveyor chain in said track below said slot, (b) a drive for said chain including two idler sprockets adjacent a portion of said slot, a drive sprocket, said sprockets being disposed to one side of said slot, said sprockets being rotatable about parallel axes forming a triangle with the base of the triangle being an imaginary line extending between the axes of said idler sprockets and generally parallel to said portion of the slot, a motor coupled to said drive sprocket, (c) a portion of said chain extending from one idler sprocket to said drive sprocket and then to said other sprocket so that most of said portion of the slot along said imaginary line does not contain said chain, (d) a tow pin transfer mechanism adjacent said portion of the slot, said mechanism including at least one movable finger for transferring a tow pin along said portion of said slot at a speed synchronized with the movement of said chain, (e) a stationary ramp in said zone below said slot which does not contain said tow conveyor chain.

2. A system in accordance with claim 1 including a separate housing embedded in said surface and containing said idler sprockets and said transfer mechanism, a separate housing embedded in said support surface and containing said drive sprocket, the depth of said housings being substantially identical with the housings having a removable cover generally flush with said support surface.

3. A system in accordance with claim 1 wherein said transfer mechanism includes a plurality of fingers rotatable about the axis parallel to the axes of said idler sprockets, and means extending between one of said idler sprockets and said transfer mechanism for rotating the transfer mechanism in synchronization with said one idler sprocket.

4. A system in accordance with claim 3 including a secondary sprocket fixedly secured to one of said idler sprockets, a secondary drive sprocket for rotating said fingers, and said means extending between one of said idler sprockets and said transfer mechanism includes a secondary chain for coupling said secondary sprocket to said secondary drive sprocket.

5. A system in accordance with claim 4 wherein said secondary sprocket has substantially the same diameter as said secondary drive sprocket.

6. A system in accordance with claim 1 wherein said drive sprocket and said motor are mounted on a common support adjustable toward and away from said imaginary line.

7. A system in accordance with claim 1 wherein a portion of said conveyor chain is adapted to contact a two pin of a vehicle being conveyed by said system, one end of said stationary ramp being adjacent one idler sprocket and at a level below said portion of said chain and the other end of said ramp being adjacent the other idler sprocket and at a level above said portion of said chain.

8. A conveyor system for use with two vehicles comprising a tow line conveyor chain, a drive for said chain including two idler sprockets and a drive sprocket, a motor coupled to said drive sprocket, said sprockets being rotatable about parallel axes which form a triangle, a portion of said chain extending from one idler sprocket to said drive sprocket and then to said other sprocket, means supporting said drive sprocket and said motor for adjustment simultaneously as a unit toward and away from an imaginary line interconnecting the axes of said idler sprockets, each of said sprockets having a lobe and notches adjacent each side edge of each lobe, at least two lobes on each sprocket extending into said conveyor chain between upper and lower links of the conveyor chain, said chain having first and second sets of links the links of any particular set being identical, the links of one set being flat plate-like members disposed one above the other, the links of the second set being disposed one above the other and having their end portions offset so that mating offset portions are closer together than the remainder of the links of the second set, the upper link of some of the second sets being upside-down so that their end portions are at an elevation above the remainder thereof to thereby create a depression for receiving a tow pin for pushing contact with an end face of an upper link of said first set.

9. A system in accordance with claim 8 wherein said chain is provided with a roller rotatable about a vertical axis at spaced points along the length of the chain at an elevation between the upper and lower links of the chain, the links of said chain being pivotable with respect to an adjacent link about a vertically disposed interconnecting pin.

10. A conveyor comprising a chain of articulated links interconnected in sets, a first set of said links being flat horizontal plates disposed one above the other, a second set of said links adjacent one end of said first set being pivotably connected thereto by a vertically disposed pin, a roller rotatable about the axis of said pin and disposed between said upper and lower links of said first set, the diameter of said roller being greater than the width of said links, each link of said second set having its end portions offset from the middle portion thereof, most of the links of said second set being arranged back-to-back so that their respective end portions are closer together as compared with the middle portions, the upper surface of the middle portion of the upper link of the second set being flush with the upper surface of said upper link of said first set, some of the upper links of said second set being disposed upside-down so that the end portions thereof are at elevations above the elevation of the middle portion to thereby create a depression at spaced points along the length of said chain for receiving a tow pin for pushing contact with an end face on an adjacent upper link of said first set.

11. A conveyor system for use with tow vehicles comprising a tow line conveyor chain, a drive for said chain including a drive sprocket for engaging and driving said chain, a motor coupled to said drive sprocket, said chain having first and second sets of links, the links of any particular set being identical, the links of one set being flat plate-like members disposed one above the other, the links of the second set being disposed one above the other and having their end portions offset so that mating offset potions are closer together than the remainder of the links of the second set, the upper link of some of the second sets being upside-down so that their end portions are at an elevation above the remainder thereof to thereby create a depression for receiving a tow pin for pushing contact with an end face of an upper link of said first set.

12. A shallow conveyor system for use with tow vehicles comprising:

(a) a support surface, a track embedded in the support surface and having a tow pin guide slot, a tow conveyor chain in said track below said slot, (b) a drive for said chain including two idler sprockets adjacent a portion of said slot, drive sprocket, said sprockets being disposed to one side of said slot, said sprockets being rotatable about parallel axes forming a triangle with the base of the triangle being an imaginary line extending between the axes of said idler sprockets and generally parallel to said portion of the slot, a motor coupled to said drive sprocket, (c) a portion of said chain extending from one idler sprocket to said drive sprocket and then to said other sprocket so that most of said portion of the slot along said imaginary line does not contain said chain, (d) a tow pin transfer mechanism adjacent said portion of the slot, said mechanism including at least one movable finger for transferring a tow pin along said portion of said slot at a speed synchronized with the movement of said chain, (e) said portion of said slot alongside said imaginary line being partially arcuate with the axis of curvature of said arcuate portion being on the opposite side of the slot from said imaginary line.

* * * * *